US009462389B2

(12) United States Patent
Wang

(10) Patent No.: US 9,462,389 B2
(45) Date of Patent: Oct. 4, 2016

(54) ANTI-IMPACT SILICON BASED MEMS MICROPHONE, A SYSTEM AND A PACKAGE WITH THE SAME

(71) Applicant: GOERTEK INC., Shandong (CN)

(72) Inventor: Zhe Wang, Shandong (CN)

(73) Assignee: GOERTEK INC. (CN)

( * ) Notice: Subject to any disclaimer, the term of this patent is extended or adjusted under 35 U.S.C. 154(b) by 222 days.

(21) Appl. No.: 14/395,787

(22) PCT Filed: Aug. 6, 2013

(86) PCT No.: PCT/CN2013/080908

§ 371 (c)(1),
(2) Date: Oct. 20, 2014

(87) PCT Pub. No.: WO2015/017979

PCT Pub. Date: Feb. 12, 2015

(65) Prior Publication Data

US 2016/0212542 A1 Jul. 21, 2016

(51) Int. Cl.

*H04R 7/16* (2006.01)
*H04R 19/00* (2006.01)
*H04R 19/04* (2006.01)

(52) U.S. Cl.

CPC ..... *H04R 7/16* (2013.01); *H04R 19/005* (2013.01); *H04R 19/04* (2013.01); *H04R 2307/023* (2013.01)

(58) Field of Classification Search

CPC ..... H04R 7/16; H04R 19/04; H04R 19/005; H04R 2307/023
USPC ..... 381/113, 174–176
See application file for complete search history.

(56) References Cited

U.S. PATENT DOCUMENTS 8,039,911 B2 * 10/2011 Nakatani ..... B81B 3/007 257/416
8,625,823 B2 * 1/2014 Buck ..... H04R 19/005 381/174

(Continued)

FOREIGN PATENT DOCUMENTS

WO 2012012939 A1 2/2012
WO 2012088688 A1 7/2012

OTHER PUBLICATIONS

International Search Report mailed May 5, 2014 for PCT/CN2013/080908.

(Continued)

*Primary Examiner* — David Ton
(74) *Attorney, Agent, or Firm* — Hauptman Ham, LLP

(57) ABSTRACT

The present invention relates to an anti-impact silicon based MEMS microphone, a system and a package with the same, the microphone comprises: a silicon substrate provided with a back hole therein; a compliant diaphragm supported on the silicon substrate and disposed above the back hole thereof; a perforated backplate disposed above the diaphragm with an air gap sandwiched in between, and further provided with one or more first thorough holes therein; and a stopper mechanism, including one or more T-shaped stoppers corresponding to the one or more first thorough holes, each of which has a lower part passing through its corresponding first thorough hole and connecting to the diaphragm and an upper part being apart from the perforated backplate and free to vertically move, wherein the diaphragm and the perforated backplate are used to form electrode plates of a variable condenser.

20 Claims, 6 Drawing Sheets

(56) References Cited

U.S. PATENT DOCUMENTS

2010/0116057 A1* 5/2010 Nakatani ..... B81C 1/00476 73/514.33
2014/0126762 A1* 5/2014 Zoellin ..... H04R 7/24 381/355

OTHER PUBLICATIONS

Written Opinion for PCT/CN2013/080908 dated May 5, 2014.

* cited by examiner

ANTI-IMPACT SILICON BASED MEMS MICROPHONE, A SYSTEM AND A PACKAGE WITH THE SAME

FIELD OF THE INVENTION

The present invention relates to the field of microphone technology, and more specifically, to an anti-impact silicon based MEMS microphone, a system and a package with the same.

BACKGROUND

Silicon based MEMS microphones, also known as acoustic transducers, have been in research and development for many years. The silicon based MEMS microphones may be widely used in many applications, such as cell phones, tablet PCs, cameras, hearing aids, smart toys and surveillance devices due to their potential advantages in miniaturization, performances, reliability, environmental endurance, costs and mass production capability.

In general, a silicon based MEMS microphone consists of a fixed perforated backplate and a highly compliant diaphragm with an air gap formed in between. The perforated backplate and the compliant diaphragm, forming a variable air-gap condenser, are typically formed on a single silicon substrate, with one of which being directly exposed to the outside through a back hole formed in the silicon substrate.

Patent application No. WO 02/15636 discloses an acoustic transducer, which has a substrate formed with a back hole therein, a diaphragm made of low stress polysilicon and directly positioned above the back hole of the substrate, and a cover member (equivalent to the said backplate) disposed above the diagram. The diaphragm can be laterally movable within its own plane parallel to the planar surface of the cover member, and thus can release its intrinsic stress, resulting very consistent mechanical compliance.

Patent document PCT/DE97/02740 discloses a miniaturized microphone, in which an SOI substrate is used for formation of the microphone and related CMOS circuits. Specifically, the silicon layer of the SOI substrate is used to form the backplate of the microphone which is directly above a back hole formed in the SOI substrate, and a subsequently deposited polysilicon thin film, which is above the backplate with an air gap in between and is exposed to the outside through the opening in the backplate and the back hole in the SOI substrate, serves to be the diaphragm of the microphone.

When a silicon microphone is packaged, it is usually mounted on a printed circuit board (PCB) with the back hole formed in the substrate of the microphone aligned with an acoustic port formed on the PCB board, so that an external acoustic wave can easily reach and vibrate the diaphragm of the microphone. For example, FIG. 1 shows a cross-sectional view of an exemplary structure of a conventional silicon based MEMS microphone package. As shown in FIG. 1, in the conventional MEMS microphone package, a MEMS microphone 10' and other integrated circuits 20 are mounted on a PCB board 30 and enclosed by a cover 40, wherein a back hole 140 formed in the substrate 100 of the MEMS microphone 10' is aligned with an acoustic port 35 formed on the PCB board 30. An external acoustic wave or a sound pressure impact, as shown by the arrows in FIG. 1, travels through the acoustic port 35 on the PCB board 30 and the back hole 140 in the substrate 100 of the microphone 10' to vibrate the diaphragm 200 of the microphone 10'.

However, as can be seen from the above description, there exists a problem with either the stand-alone conventional MEMS microphones or the conventional MEMS microphone package with the same, which is that the fragile and brittle diaphragm of the conventional MEMS microphones is easily damaged due to a very high sound pressure impact caused, for example, in a drop test.

SUMMARY

In order to solve the above problems, the present invention provides an anti-impact silicon based MEMS microphone with a stopper mechanism, which may help to restrain the fragile and brittle diaphragm from large movement induced by sound pressure impact in, for example, a drop test and thus prevent the diaphragm from being damaged.

In one aspect of the present invention, there is provided an anti-impact silicon based MEMS microphone, comprising: a silicon substrate provided with a back hole therein; a compliant diaphragm supported on the silicon substrate and disposed above the back hole of the silicon substrate; a perforated backplate disposed above the diaphragm with an air gap sandwiched in between, and further provided with one or more first thorough holes therein; and a stopper mechanism, including one or more T-shaped stoppers corresponding to the one or more first thorough holes, each of which has a lower part passing through its corresponding first thorough hole and connecting to the diaphragm and an upper part being apart from the perforated backplate and free to vertically move, wherein the diaphragm and the perforated backplate are used to form electrode plates of a variable condenser.

Preferably, the one or more stoppers each may be made of stacked layers of one or more materials selected from a group consisting of metals, semiconductors and insulators.

Preferably, the anti-impact silicon based MEMS microphone may further comprise dimples protruding from the lower surface of the perforated backplate opposite to the diaphragm.

Preferably, said compliant diaphragm may be formed with a part of a silicon device layer or a polysilicon layer stacked on the silicon substrate with an oxide layer sandwiched in between.

Preferably, said perforated backplate may be formed with CMOS passivation layers with a metal layer imbedded therein which serves as an electrode plate of the backplate, or said perforated backplate may be formed with a polysilicon layer or a SiGe layer.

In one example, the anti-impact silicon based MEMS microphone may further include an interconnection column provided between the edge of diaphragm and the edge of the backplate for electrically wiring out the diaphragm, and the periphery of the diaphragm is fixed. In this situation, preferably, the stopper mechanism may include one stopper with the lower part thereof connecting to the center of the diaphragm, or the stopper mechanism may include a plurality of stoppers with the lower parts thereof uniformly and/or symmetrically connecting to the diaphragm in the vicinity of the edge thereof.

In another example, the anti-impact silicon based MEMS microphone may further include an interconnection column provided between the center of the diaphragm and the center of the backplate for mechanically suspending and electrically wiring out the diaphragm, and the periphery of the diaphragm is free to vibrate. In this situation, preferably, the stopper mechanism may include a plurality of stoppers with the lower parts thereof uniformly and/or symmetrically connecting to the diaphragm in the vicinity of the edge thereof.

In another aspect of the present invention, there is provided an anti-impact silicon based MEMS microphone, comprising: a silicon substrate provided with a back hole therein; a perforated backplate supported on the silicon substrate and disposed above the back hole of the silicon substrate; a compliant diaphragm disposed above the perforated backplate with an air gap sandwiched in between, and provided with one or more first thorough holes therein; and a stopper mechanism, including one or more T-shaped stoppers corresponding to the one or more first thorough holes, each of which has a lower part passing through its corresponding first thorough hole and connecting to the perforated backplate and an upper part being apart from the diaphragm, wherein the perforated backplate and the diaphragm are used to form electrode plates of a variable condenser.

Preferably, the one or more stoppers each are made of stacked layers of one or more materials selected from a group consisting of metals, semiconductors and insulators.

Preferably, the anti-impact silicon based MEMS microphone may further comprise dimples protruding from the lower surface of the diaphragm opposite to the perforated backplate.

Preferably, said perforated backplate may be formed with a part of a silicon device layer or a polysilicon layer stacked on the silicon substrate with an oxide layer sandwiched in between.

Preferably, said compliant diaphragm may be formed with a polysilicon layer or a SiGe layer.

In still another aspect of the present invention, there is provided a microphone system, comprising any of the anti-impact silicon based MEMS microphones mentioned above and a CMOS circuitry integrated on a single chip.

In still yet another aspect of the present invention, there is provided a microphone package, comprising a PCB board; any of the anti-impact silicon based MEMS microphones mentioned above, mounted on the PCB board; and a cover, enclosing the microphone, wherein an acoustic port is formed on any of the PCB board and the cover, so that an external acoustic wave may travel through the acoustic port or travel through the acoustic port and the back hole in the silicon substrate to vibrate the diaphragm.

As can be seen from above description, when a sound pressure impact caused, for example, in a drop test travels through the back hole in the substrate in a stand-alone microphone or a microphone system, or through the acoustic port on the PCB board and the back hole in the substrate of the microphone in a microphone package according to the present invention to vibrate the diaphragm of the microphone, the stopper mechanism may prevent the diaphragm from a large deflection away from the backplate, and the backplate may prevent the diaphragm from a large deflection towards the backplate, thus the anti-impact silicon based MEMS microphones according to the present invention may restrain the fragile and brittle diaphragm thereof from large movement induced by sound pressure impact in, for example, a drop test, and thus reduce the stress concentrated on the diaphragm, increase the mechanical stability of the diaphragm and prevent the diaphragm from being damaged in the drop test.

While various embodiments have been discussed in the summary above, it should be appreciated that not necessarily all embodiments include the same features and some of the features described above are not necessary but can be desirable in some embodiments. Numerous additional features, embodiments and benefits are discussed in the detailed description which follows.

BRIEF DESCRIPTION OF THE DRAWINGS

The objectives and features of the present invention will become apparent from the following description of embodiments, given in conjunction with the accompanying drawings, in which.

DETAILED DESCRIPTION

Figure 1:
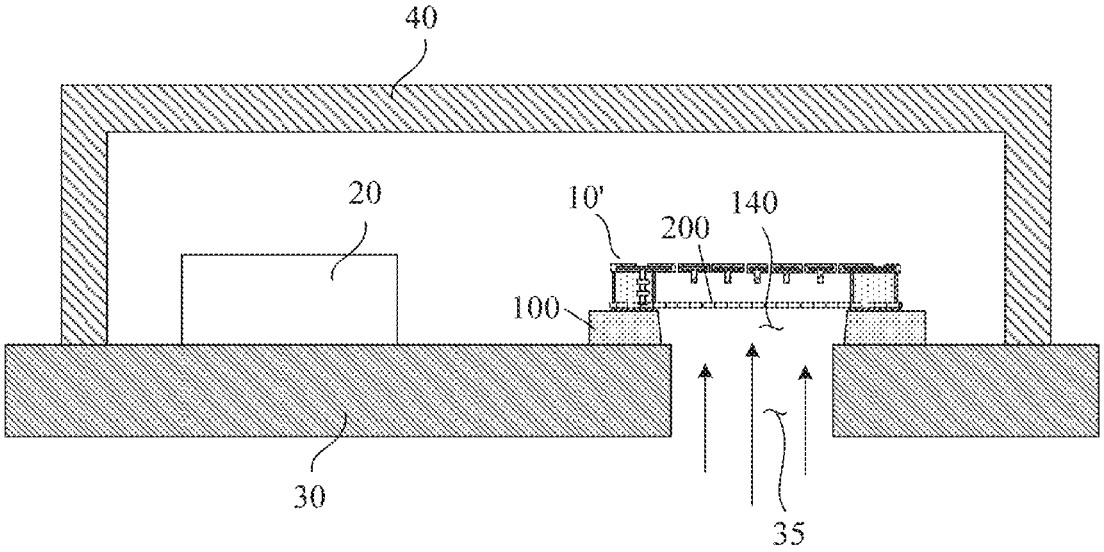
FIG. 1 is a cross-sectional view showing an exemplary structure of a conventional silicon based MEMS microphone package.

Various aspects of the claimed subject matter are now described with reference to the drawings, wherein the illustrations in the drawings are schematic and not to scale, and like reference numerals are used to refer to like elements throughout. In the following description, for purposes of explanation, numerous specific details are set forth in order to provide a thorough understanding of one or more aspects. It may be evident, however, that such aspect(s) may be practiced without these specific details. In other instances, well-known structures and devices are shown in block diagram form in order to facilitate describing one or more aspects.

In the description and the appended claims, it will be understood that, when a layer, a region, or a component is referred to as being "on" or "under" another layer, another region, or another component, it can be "directly" or "indirectly" on or under the another layer, region, or component, or one or more intervening layers may also be present.

Generally speaking, an anti-impact silicon based MEMS microphone according to the present invention comprises a silicon substrate provided with a back hole therein, a compliant diaphragm, a perforated backplate and a stopper mechanism, wherein the diaphragm and the perforated backplate are used to form electrode plates of a variable condenser. The compliant diaphragm may be supported on the silicon substrate and disposed above the back hole of the silicon substrate with the perforated backplate disposed above the diaphragm with an air gap sandwiched in between. In this situation, the perforated backplate is further provided with one or more first thorough holes therein, and the stopper mechanism may include one or more T-shaped stoppers corresponding to the one or more first thorough holes, each of which has a lower part passing through its corresponding first thorough hole and connecting to the diaphragm and an upper part being apart from the perforated backplate and free to vertically move. Alternatively, the perforated backplate may be supported on the silicon substrate and disposed above the back hole of the silicon substrate with the compliant diaphragm disposed above the perforated backplate with an air gap sandwiched in between. In this situation, the diaphragm is further provided with one or more first thorough holes therein, and the stopper mechanism may include one or more T-shaped stoppers corresponding to the one or more first thorough holes, each of which has a lower part passing through its corresponding first thorough hole and connecting to the perforated backplate and an upper part being apart from the diaphragm.

The inventive concepts of the present invention are as follows: a sound pressure impact caused, for example, in a drop test travels through the back hole in the substrate of the anti-impact microphone according to the present invention to vibrate the diaphragm of the microphone. When the diaphragm deflects away from the backplate to some extent, it will be restricted by the upper parts of the one or more stoppers from further deflecting away from the backplate, and when the diaphragm deflects towards the backplate to some extent, it will be restricted by the backplate from further deflecting towards the backplate. Therefore, the anti-impact silicon based MEMS microphone according to the present invention may restrain the fragile and brittle diaphragm thereof from large movement induced by sound pressure impact in, for example, a drop test, and thus prevent the diaphragm from being damaged in the drop test.

The one or more T-shaped stoppers each may be formed, according to the specific formation procedure of the microphone, with stacked layers of one or more materials selected from a group consisting of metals (such as copper, aluminum, titanium and so on), semiconductors (such as poly silicon) and insulators (such as the CMOS dielectric silicon oxide including LPCVD or PEVCD oxide, PSG or BPSG oxide or a combination thereof, the CMOS passivation materials including PECVD silicon nitride, and so on).

Furthermore, in order to prevent the diaphragm from sticking to the backplate, the anti-impact silicon based MEMS microphone according to the present invention may further comprise dimples protruding from the lower surface of the perforated backplate opposite to the diaphragm in case that the perforated backplate is disposed above the diaphragm, or protruding from the lower surface of the diaphragm opposite to the perforated backplate in case that the diaphragm is disposed above the perforated backplate.

Hereinafter, embodiments of the present invention will be described in details with reference to the accompanying drawings to explain the structure of the microphone described above.

(The First Embodiment)

Figure 2:
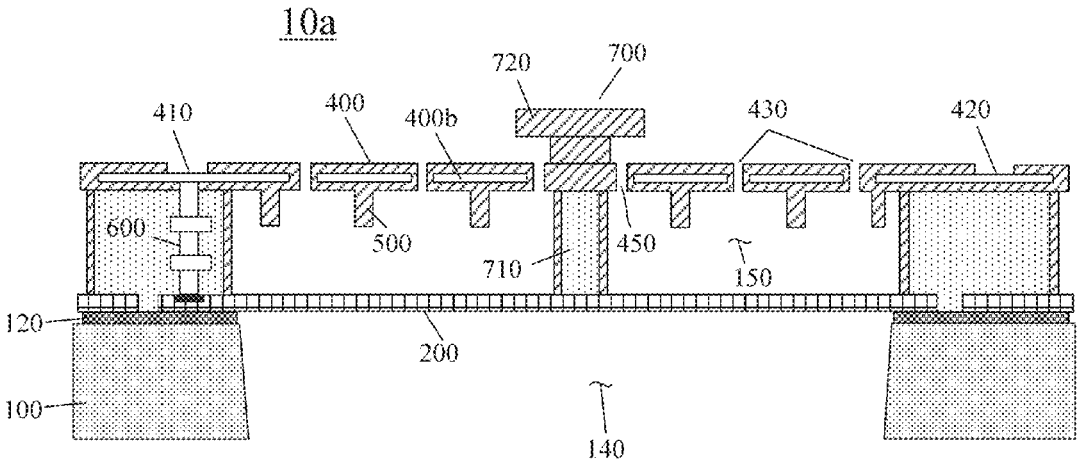
FIG. 2 is a cross-sectional view showing the structure of the anti-impact silicon based MEMS microphone according to the first embodiment of the present invention.
Figure 3:
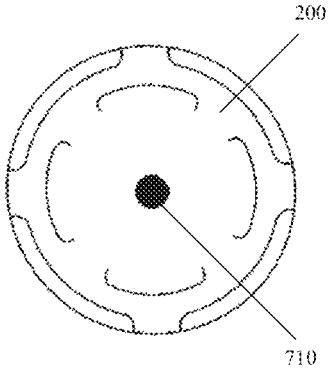
FIG. 3 is a plan view showing an exemplary pattern of the diaphragm of the microphone of FIG. 2 when viewed from the top side of the diaphragm.

FIG. 2 is a cross-sectional view showing the structure of the anti-impact silicon based MEMS microphone according to the first embodiment of the present invention. FIG. 3 is a plan view showing an exemplary pattern of the diaphragm of the microphone of FIG. 2 when viewed from the top side of the diaphragm. A MEMS microphone may receive an acoustic signal and transform the received acoustic signal into an electrical signal for the subsequent processing and output.

As shown in FIG. 2, the anti-impact silicon based MEMS microphone 10*a* according to the first embodiment of the present invention includes a silicon substrate 100 provided with a back hole 140 therein, a conductive and compliant diaphragm 200, a perforated backplate 400, and an air gap 150. The diaphragm 200 is formed with a part of a silicon device layer such as the top-silicon film on a silicon-on-insulator (SOI) wafer or formed with a polycrystalline silicon (or polysilicon) membrane through a deposition process, and stacked on the silicon substrate 100 with an oxide layer 120 sandwiched in between. The perforated backplate 400 is located above the diaphragm 200, and formed with CMOS passivation layers with a metal layer 400*b* imbedded therein which serves as an electrode plate of the backplate 400. In another example, the perforated backplate 400 may be formed with a polysilicon layer or a low temperature SiGe layer. The air gap 150 is formed between the diaphragm 200 and the backplate 400. The conductive and compliant diaphragm 200 serves as an electrode, as well as a vibration membrane which vibrates in response to an external acoustic wave or a sound pressure impact reaching the diaphragm 200 through the back hole 140. The backplate 400 provides another electrode of the microphone 10*a*, and has a plurality of second through holes 430 formed therein, which are used for air ventilation so as to reduce air damping that the diaphragm 200 will encounter when starts vibrating. Therefore, the diaphragm 200 and electrode plate of the backplate 400 forms a variable condenser, which has an extraction electrode 410 for the diaphragm 200 and an extraction electrode 420 for the backplate 400.

The anti-impact silicon based MEMS microphone 10*a* may further include an interconnection column 600 provided between the edge of diaphragm 200 and the edge of the backplate 400 for electrically wiring out the diaphragm 200, and the periphery of the diaphragm 200 is fixed.

The anti-impact silicon based MEMS microphone 10*a* may further include dimples 500 protruding from the lower surface of the perforated backplate 400 opposite to the diaphragm 200, and used to prevent the diaphragm 200 from sticking to the backplate 400.

Examples of the above structure of the microphone 10*a* and the processing method thereof are described in details in the international application No. PCT/CN2010/075514, the related contents of which are incorporated herein by reference.

Furthermore, in the anti-impact silicon based MEMS microphone 10*a* according to the first embodiment of present invention, as shown in FIG. 2, a first thorough hole 450 is formed in the center of the perforated backplate 400, and a stopper mechanism including one T-shaped stopper 700 corresponding to the first thorough hole 450 is formed in the center of the diaphragm 200, the T-shaped stopper 700 has a lower part 710 passing through its corresponding first thorough hole 450 and connecting to the center of the diaphragm 200 as shown in FIG. 3 and an upper part 720 being apart from the perforated backplate 400 and free to vertically move. In the first embodiment, the stopper 700 may be formed with, from the bottom to the top, a CMOS dielectric silicon oxide layer and three CMOS passivation layers stacked one on the top of another, and the oxide layer and the first two passivation layers form the lower part 710 of the stopper 700, and the last passivation layer forms the upper part 720 of the stopper 700. In the present invention, it should be noted that the shape of the stopper is not necessarily a well-defined T shape. In fact, any T-like stopper will work as long as the lower part thereof can pass through the first thorough hole 450 to serve as a connecting part and the upper part thereof cannot pass through the first thorough hole 450 so as to serve as a restricting part.

Figure 4:
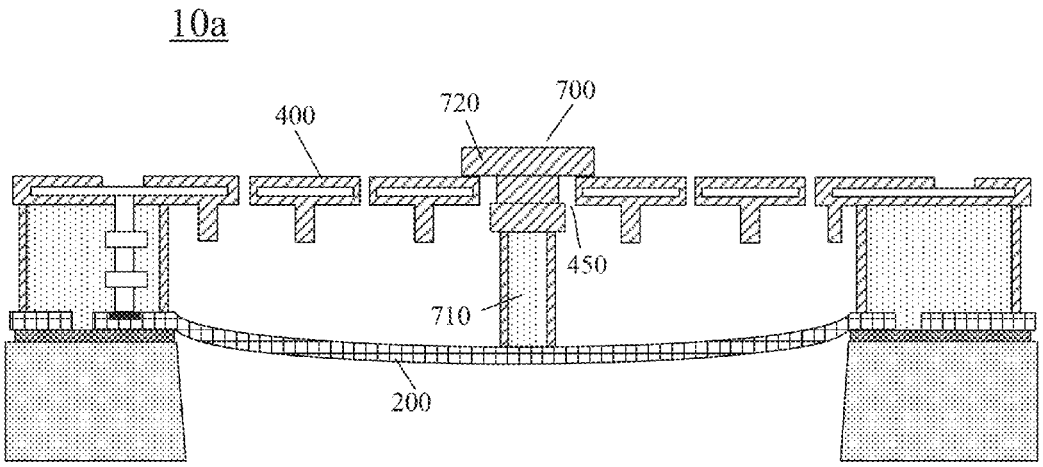
FIG. 4 and FIG. 5 are cross-sectional views, showing a large deflection of the diaphragm of the microphone of FIG. 2 away from and towards the backplate, respectively.
Figure 5:
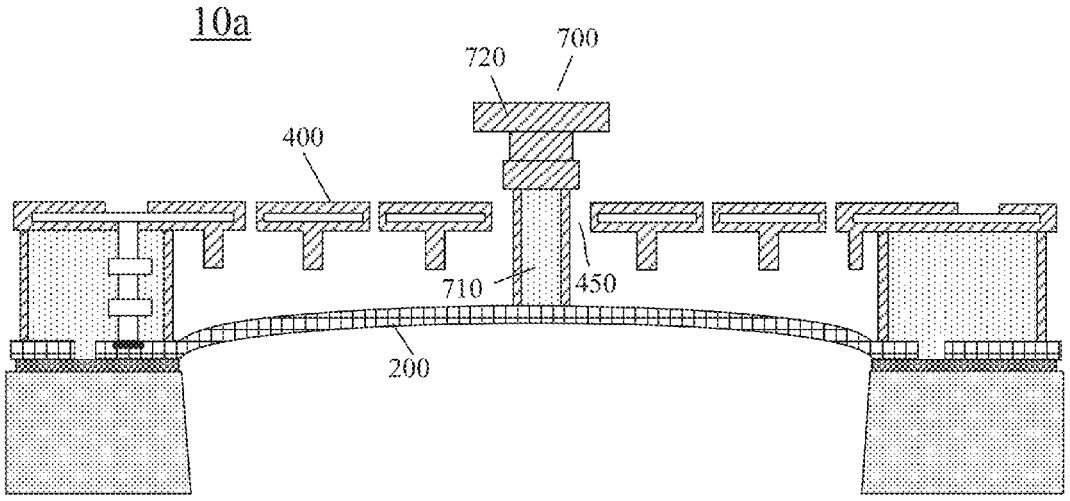

FIG. 4 and FIG. 5 are cross-sectional views, showing a large deflection of the diaphragm of the microphone of FIG. 2 away from and towards the backplate, respectively.

As shown in FIG. 4, when the diaphragm 200 deflects, under a sound pressure impact, away from the backplate to some extent, the upper part 720 of the stopper 700 will touch the upper surface of the backplate 400, thus restrain the diaphragm 200 from further deflecting away from the backplate 400. As shown in FIG. 5, when the diaphragm 200 deflects, under a sound pressure impact, towards the backplate 400 to some extent, the backplate 400 will restrain the diaphragm 200 from further deflecting towards the backplate 400. Therefore, the anti-impact silicon based MEMS microphone 10*a* according to the first embodiment of the present invention may restrain the fragile and brittle diaphragm 200 thereof from large movement induced by a sound pressure impact in, for example, a drop test, and thus prevent the diaphragm from being damaged in the drop test.

(The Second Embodiment)

Figure 6:
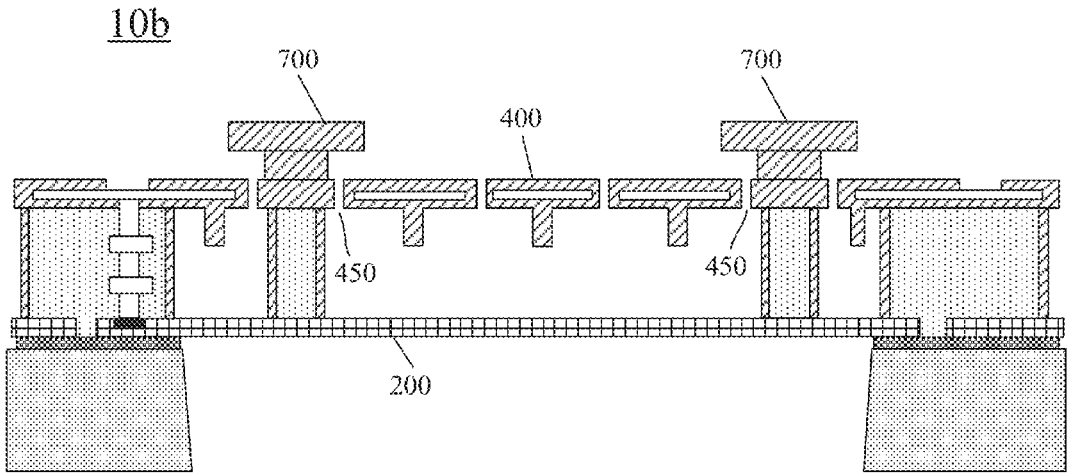
FIG. 6 is a cross-sectional view showing the structure of the anti-impact silicon based MEMS microphone according to the second embodiment of the present invention.
Figure 7:
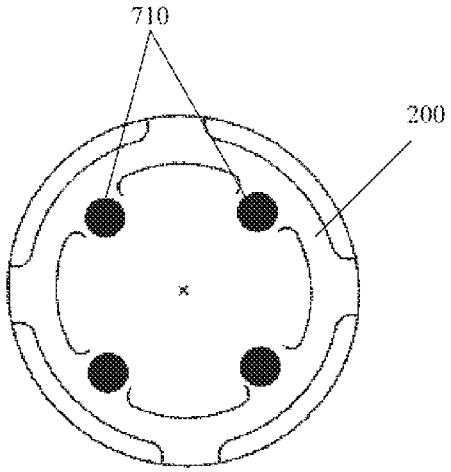
FIG. 7 is a plan view showing an exemplary pattern of the diaphragm of the microphone of FIG. 6 when viewed from the top side of the diaphragm.

FIG. 6 is a cross-sectional view showing the structure of the anti-impact silicon based MEMS microphone according to the second embodiment of the present invention. FIG. 7 is a plan view showing an exemplary pattern of the diaphragm of the microphone of FIG. 6 when viewed from the top side of the diaphragm.

Comparing FIG. 6 with FIG. 2 and FIG. 7 with FIG. 3, the anti-impact silicon based MEMS microphone 10*b* according to the second embodiment is distinguished from that of the first embodiment in that, in the second embodiment, a plurality of first thorough holes 450 are uniformly and/or symmetrically formed in the vicinity of the edge of the backplate 400, and the stopper mechanism including a plurality of stoppers 700 corresponding to the plurality of first thorough holes 450 are uniformly and/or symmetrically formed in the vicinity of the edge of the diaphragm 200, each T-shaped stopper 700 has a lower part 710 passing through its corresponding first thorough hole 450 and connecting to the diaphragm 200 in the vicinity of the edge of the diaphragm 200 as shown in FIG. 7, and an upper part 720 being apart from the perforated backplate 400 and free to vertically move.

(The Third Embodiment)

Figure 8:
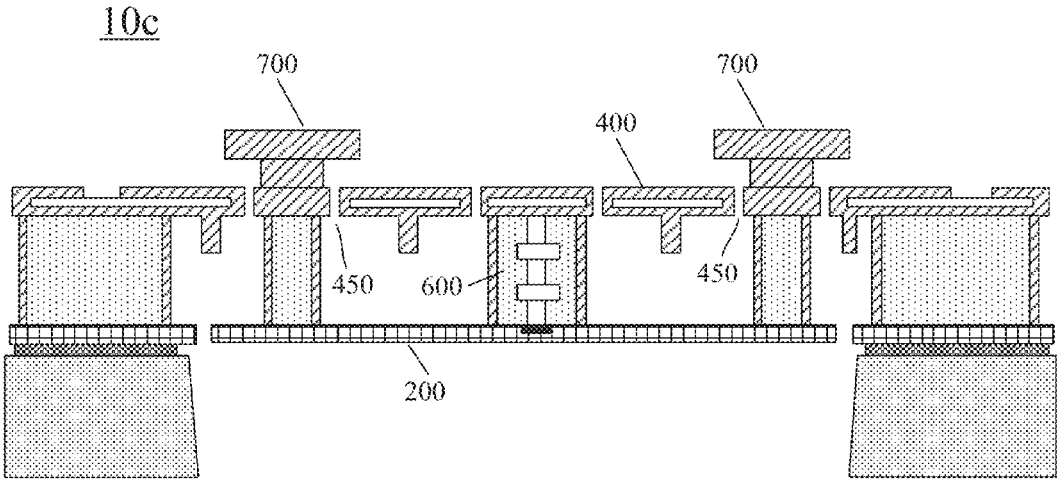
FIG. 8 is a cross-sectional view showing the structure of the anti-impact silicon based MEMS microphone according to the third embodiment of the present invention.

FIG. 8 is a cross-sectional view showing the structure of the anti-impact silicon based MEMS microphone according to the third embodiment of the present invention.

Comparing FIG. 8 with FIG. 6, the anti-impact silicon based MEMS microphone 10*c* of the third embodiment is distinguished from that of the second embodiment in that, in the third embodiment, the anti-impact silicon based MEMS microphone 10*c* includes an interconnection column 600 provided between the center of the diaphragm 200 and the center of the backplate 400 for mechanically suspending and electrically wiring out the diaphragm 200, and the periphery of the diaphragm 200 is free to vibrate. Examples of the above structure of the microphone 10*c* and the processing method thereof are described in details in the international application No. PCT/CN2010/075514, the related contents of which are incorporated herein by reference.

In the third embodiment, similar to the second embodiment, a plurality of first thorough holes 450 are uniformly and/or symmetrically formed in the vicinity of the edge of the backplate 400, and the stopper mechanism including a plurality of stoppers 700 corresponding to the plurality of first thorough holes 450 are uniformly and/or symmetrically formed in the vicinity of the edge of the diaphragm 200, each T-shaped stopper 700 has a lower part 710 passing through its corresponding first thorough hole 450 and connecting to the diaphragm 200 in the vicinity of the edge of the diaphragm 200, and an upper part 720 being apart from the perforated backplate 400 and free to vertically move.

Three embodiments of the anti-impact silicon based MEMS microphone according to the present invention have been described with reference to FIG. 2-FIG. 8, however, the present invention is not limited thereto. As a alternative, the anti-impact silicon based MEMS microphone according to the present invention may have a structure in which a perforated backplate is above the back hole of the silicon substrate, a compliant diaphragm is above the perforate backplate, one or more T-shaped stoppers pass through one or more corresponding first thorough holes formed on the diaphragm and fix on the perforated backplate, as described in details in the following fourth embodiment.

(The Fourth Embodiment)

Figure 9:
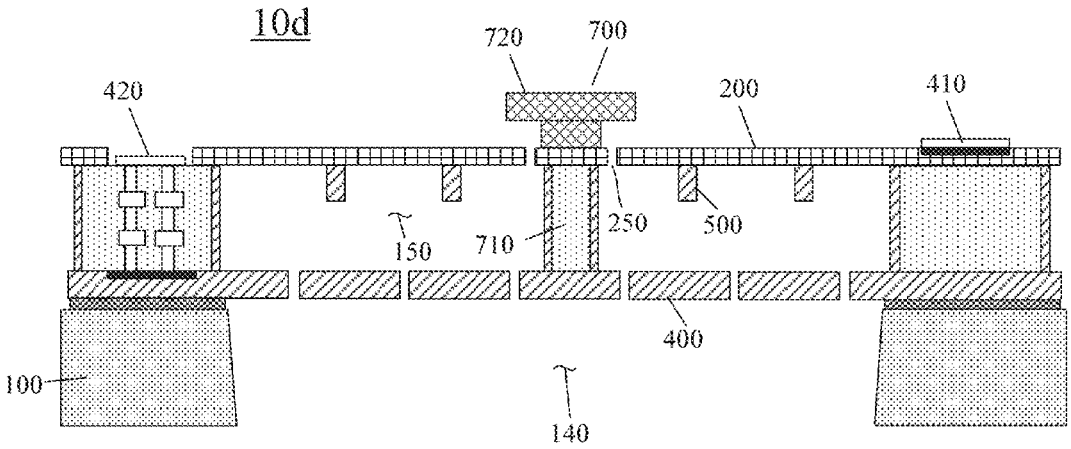
FIG. 9 is a cross-sectional view showing the structure of the anti-impact silicon based MEMS microphone according to the fourth embodiment of the present invention.

FIG. 9 is a cross-sectional view showing the structure of the anti-impact silicon based MEMS microphone according to the fourth embodiment of the present invention. As shown in FIG. 9, the anti-impact silicon based MEMS microphone 10*d* according to the fourth embodiment of the present invention comprises: a silicon substrate 100 provided with a back hole 140 therein; a perforated backplate 400 supported on the silicon substrate 100 and disposed above the back hole 140 of the silicon substrate 100; a compliant diaphragm 200 disposed above the perforated backplate 400 with an air gap 150 sandwiched in between. The perforated backplate 400 and the diaphragm 200 are used to form electrode plates of a variable condenser, which has an extraction electrode 420 for the backplate 400 and an extraction electrode 410 for the diaphragm 200. The perforated backplate 400 may be formed with a part of a silicon device layer or a polysilicon layer, which can withstand high temperature in the subsequent processes, stacked on the silicon substrate with an oxide layer sandwiched in between. The compliant diaphragm 200 may be formed with a polysilicon layer or a low temperature SiGe layer.

Furthermore, the anti-impact silicon based MEMS microphone 10*d* may further comprise dimples 500 protruding from the lower surface of the diaphragm 200 opposite to the perforated backplate 400, in order to prevent the diaphragm 200 from sticking to the backplate 400.

In addition, a first thorough hole 250 is formed in the center of the diaphragm 200, and a stopper mechanism including one T-shaped stopper 700 corresponding to the first thorough hole 250 is formed in the center of perforated backplate 400, the T-shaped stopper 700 has a lower part 710 passing through its corresponding first thorough hole 250 and connecting to the center of the perforated backplate 400 and an upper part 720 being apart from the diaphragm 200. In the present embodiment, the stopper 700 may be formed with, from the bottom to the top, a CMOS dielectric silicon oxide layer, a poly silicon layer and two other layers of metal or semiconductor or insulator or the combination thereof (preferably two CMOS passivation layers, for example SiN) stacked one on the top of another, and the oxide layer, the poly silicon layer and the first other layer form the lower part 710 of the stopper 700, and the second other layer forms the upper part 720 of the stopper 700.

It should be noted that, in an alternative example, a plurality of first thorough holes 250 may be uniformly and/or symmetrically formed in the vicinity of the edge of the diaphragm 200, and a stopper mechanism including a plurality of stoppers 700 corresponding to the plurality of first thorough holes 250 may be uniformly and/or symmetrically formed in the vicinity of the edge of the backplate 400, each T-shaped stopper 700 has a lower part 710 passing through its corresponding first thorough hole 250 and connecting to the backplate 400 in the vicinity of the edge of the backplate 400, and an upper part 720 being apart from the diaphragm 200.

In addition, the one or more stoppers each may be made of stacked layers of one or more materials selected from a group consisting of metals (such as copper, aluminum, titanium and so on), semiconductors (such as poly silicon) and insulators (such as the CMOS dielectric silicon oxide including LPCVD or PEVCD oxide, PSG or BPSG oxide or a combination thereof, the CMOS passivation materials including PECVD silicon nitride, and so on).

Refer to FIG. 9, when the diaphragm 200 deflects, under a sound pressure impact, away from the backplate 400 to some extent, it will touch the upper part 720 of the stopper 700, thus will be restricted by the upper part 720 of the stopper 700 from further deflecting away from the backplate 400. When the diaphragm 200 deflects, under a sound pressure impact, towards the backplate 400 to some extent, it will be restricted by the backplate 400 from further deflecting towards the backplate 400. Therefore, the anti-impact silicon based MEMS microphone 10*d* of the fourth embodiment may restrain the fragile and brittle diaphragm 200 thereof from large movement induced by a sound pressure impact in, for example, a drop test, and thus prevent the diaphragm from being damaged in the drop test.

Furthermore, any anti-impact silicon based MEMS microphone according to the present invention can be integrated with a CMOS circuitry on a single chip to form a microphone system.

Hereinafter, a microphone package according to the present invention will be briefly described with reference to FIG. 10.

Figure 10:
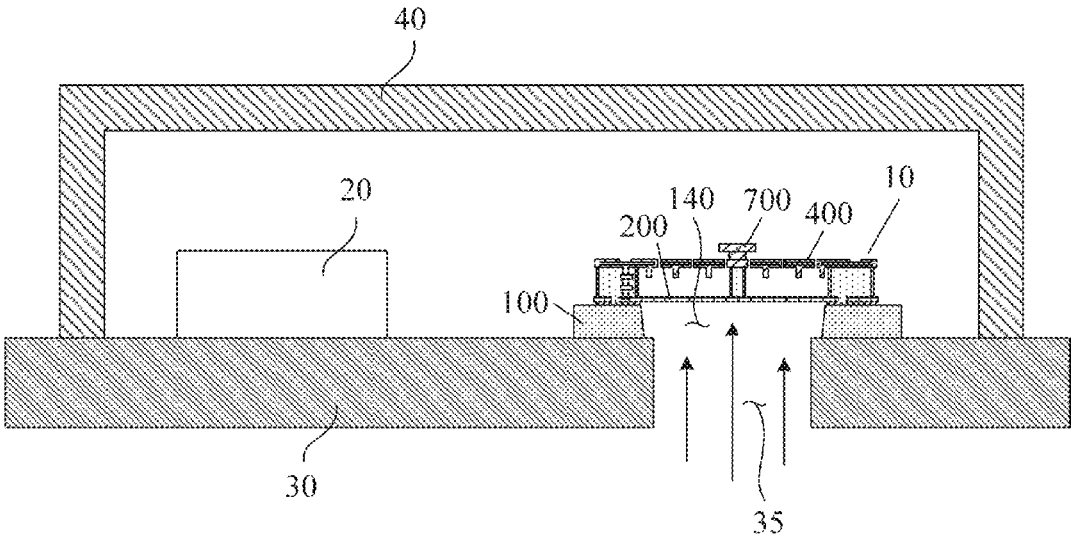
FIG. 10 is a cross-sectional view showing an exemplary structure of an anti-impact silicon based MEMS microphone package according to the present invention.

FIG. 10 is a cross-sectional view showing an exemplary structure of a silicon based MEMS microphone package according to the present invention. As shown in FIG. 10, a microphone package according to the present invention comprises a PCB board provided with an acoustic port thereon, an anti-impact silicon based MEMS microphone according to the present invention, and a cover.

Specifically, in an anti-impact silicon based MEMS microphone package according to the present invention, as shown in FIG. 10, an anti-impact silicon based MEMS microphone 10 according to the present invention and other integrated circuits 20 are mounted on a PCB board 30 and enclosed by a cover 40, wherein the back hole 140 formed in the substrate 100 of the MEMS microphone 10 is aligned with an acoustic port 35 formed on the PCB board 30. An external acoustic wave or a sound pressure impact, as shown by the arrows in FIG. 10, travels through the acoustic port 35 on the PCB board 30 and the back hole 140 in the substrate 100 of the microphone 10 to vibrate the diaphragm 200 of the microphone 10.

It should be noted that the acoustic port 35 may be formed on any of the PCB board and the cover in a manner that an external acoustic wave may travel through the acoustic port or travel through the acoustic port and the back hole in the silicon substrate to vibrate the diaphragm.

When a sound pressure impact caused, for example, in a drop test travels through the acoustic port 35 on the PCB board 30 and the back hole 140 in the substrate 100 of the microphone 10 in a microphone package according to the present invention to vibrate the diaphragm 200 of the microphone 10, the stopper mechanism may prevent the diaphragm 200 from a large deflection away from the backplate 400, and the backplate 400 may prevent the diaphragm 200 from a large deflection towards the backplate 400, thus the silicon based MEMS microphone package according to the present invention may prevent the diaphragm 200 from being damaged in the drop test.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples described herein but is to be accorded the widest scope consistent with the principles and novel features disclosed herein.

The invention claimed is:

1. An anti-impact silicon based MEMS microphone, comprising:

a silicon substrate provided with a back hole therein;

a compliant diaphragm supported on the silicon substrate and disposed above the back hole of the silicon substrate;

a perforated backplate disposed above the diaphragm with an air gap sandwiched in between, and further provided with one or more first thorough holes therein; and a stopper mechanism, including one or more T-shaped stoppers corresponding to the one or more first thorough holes, each of which has a lower part passing through its corresponding first thorough hole and connecting to the diaphragm and an upper part being apart from the perforated backplate and free to vertically move, wherein the diaphragm and the perforated backplate are used to form electrode plates of a variable condenser.

2. An anti-impact silicon based MEMS microphone of claim 1, wherein the one or more stoppers each are made of stacked layers of one or more materials selected from a group consisting of metals, semiconductors and insulators.

3. An anti-impact silicon based MEMS microphone of claim 1, further comprising dimples protruding from the lower surface of the perforated backplate opposite to the diaphragm.

4. An anti-impact silicon based MEMS microphone of claim 1, wherein said compliant diaphragm is formed with a part of a silicon device layer or a polysilicon layer stacked on the silicon substrate with an oxide layer sandwiched in between.

5. An anti-impact silicon based MEMS microphone of claim 1, wherein said perforated backplate is formed with CMOS passivation layers with a metal layer imbedded therein which serves as an electrode plate of the backplate.

6. An anti-impact silicon based MEMS microphone of claim 1, wherein said perforated backplate is formed with a polysilicon layer or a SiGe layer.

7. An anti-impact silicon based MEMS microphone of claim 1, wherein the anti-impact silicon based MEMS microphone further includes an interconnection column provided between the edge of diaphragm and the edge of the backplate for electrically wiring out the diaphragm, and the periphery of the diaphragm is fixed.

8. An anti-impact silicon based MEMS microphone of claim 7, wherein the stopper mechanism includes one stopper with the lower part thereof connecting to the center of the diaphragm.

9. An anti-impact silicon based MEMS microphone of claim 7, wherein the stopper mechanism includes a plurality of stoppers with the lower parts thereof uniformly and/or symmetrically connecting to the diaphragm in the vicinity of the edge thereof.

10. An anti-impact silicon based MEMS microphone of claim 1, wherein the anti-impact silicon based MEMS microphone further includes an interconnection column provided between the center of the diaphragm and the center of the backplate for mechanically suspending and electrically wiring out the diaphragm, and the periphery of the diaphragm is free to vibrate.

11. An anti-impact silicon based MEMS microphone of claim 10, wherein the stopper mechanism includes a plurality of stoppers with the lower parts thereof uniformly and/or symmetrically connecting to the diaphragm in the vicinity of the edge thereof.

12. An anti-impact silicon based MEMS microphone, comprising:

a silicon substrate provided with a back hole therein;

a perforated backplate supported on the silicon substrate and disposed above the back hole of the silicon substrate;

a compliant diaphragm disposed above the perforated backplate with an air gap sandwiched in between, and provided with one or more first thorough holes therein;

a stopper mechanism, including one or more T-shaped stoppers corresponding to the one or more first thorough holes, each of which has a lower part passing through its corresponding first thorough hole and connecting to the perforated backplate and an upper part being apart from the diaphragm, wherein the perforated backplate and the diaphragm are used to form electrode plates of a variable condenser.

13. An anti-impact silicon based MEMS microphone of claim 12, wherein the one or more stoppers each are made of stacked layers of one or more materials selected from a group consisting of metals, semiconductors and insulators.

14. An anti-impact silicon based MEMS microphone of claim 12, further comprising dimples protruding from the lower surface of the diaphragm opposite to the perforated backplate.

15. An anti-impact silicon based MEMS microphone of claim 12, wherein said perforated backplate is formed with a part of a silicon device layer or a polysilicon layer stacked on the silicon substrate with an oxide layer sandwiched in between.

16. An anti-impact silicon based MEMS microphone of claim 12, wherein said compliant diaphragm is formed with a polysilicon layer or a SiGe layer.

17. A microphone system, comprising an anti-impact silicon based MEMS microphone of claim claim 12 and a CMOS circuitry integrated on a single chip.

18. A microphone package, comprising a PCB board; an anti-impact silicon based MEMS microphone of claim 12, mounted on the PCB board; and a cover, enclosing the microphone, wherein an acoustic port is formed on any of the PCB board and the cover, so that an external acoustic wave travels through the acoustic port or travels through the acoustic port and the back hole in the silicon substrate to vibrate the diaphragm.

19. A microphone system, comprising an anti-impact silicon based MEMS microphone of claim 1 and a CMOS circuitry integrated on a single chip.

20. A microphone package, comprising a PCB board; an anti-impact silicon based MEMS microphone of claim 1, mounted on the PCB board; and a cover, enclosing the microphone, wherein an acoustic port is formed on any of the PCB board and the cover, so that an external acoustic wave travels through the acoustic port or travels through the acoustic port and the back hole in the silicon substrate to vibrate the diaphragm.

* * * * *